United States Patent [19]

Secemski et al.

[11] Patent Number: 4,566,993

[45] Date of Patent: Jan. 28, 1986

[54] LIQUID DETERGENTS CONTAINING CELLULOSE ETHERS STABILIZED BY GLYCEROL

[75] Inventors: Isaac I. Secemski, Flushing; Joseph J. Podgorsky, Slate Hill, both of N.Y.

[73] Assignee: Lever Brothers Company, New York, N.Y.

[21] Appl. No.: 621,288

[22] Filed: Jun. 15, 1984

[51] Int. Cl.[4] ..... C11D 1/12; C11D 1/755

[52] U.S. Cl. ..... 252/559; 252/173; 252/174.17; 252/174.19; 252/174.24; 252/DIG. 1; 252/DIG. 14; 252/DIG. 15

[58] Field of Search ..... 252/534, 553, 540, 559, 252/174.17, DIG. 14, DIG. 13, 2, DIG. 15, 173, 174.19, 170, 174.21

[56] References Cited

U.S. PATENT DOCUMENTS

| | | | |
|---|---|---|---|
| 3,179,595 | 4/1965 | Olson | 252/118 |
| 3,328,305 | 6/1967 | Lamberti | 252/89 |
| 3,850,831 | 11/1974 | Hellsten et al. | 252/99 |
| 3,890,434 | 6/1975 | Weisse et al. | 424/70 |
| 4,000,093 | 12/1976 | Nicol et al. | 252/529 |
| 4,048,433 | 9/1977 | Burns et al. | 252/174.17 |
| 4,174,305 | 11/1979 | Burns et al. | 252/545 |
| 4,226,736 | 10/1980 | Bush et al. | 252/174.17 |
| 4,364,837 | 12/1982 | Pader | 252/173 |
| 4,368,147 | 1/1983 | Inamorato et al. | 252/545 |

FOREIGN PATENT DOCUMENTS 0079641 5/1983 European Pat. Off. .

*Primary Examiner*—Paul Lieberman
*Assistant Examiner*—John F. McNally

[57] ABSTRACT

A heavy duty liquid detergent is provided whose cellulose ether component is stabilized against lump formation and separation by the presence of glycerol. Freeze-thaw and low temperature storage stability is thereby particularly improved. These aqueous liquid detergent compositions comprise:

(1) from about 0.5% to about 2% glycerol;
(2) from about 0.05% to about 1% cellulose ether;
(3) from about 3% to about 6% of a nonionic surfactant; and
(4) from about 10% to about 25% of an anionic surfactant.

14 Claims, No Drawings

LIQUID DETERGENTS CONTAINING CELLULOSE ETHERS STABILIZED BY GLYCEROL

BACKGROUND OF THE INVENTION

1. Field of the Invention

The invention relates to heavy duty liquid detergents whose cellulose ether component is stabilized against lump formation and separation.

2. The Prior Art

Cellulose ether polymers have long been used in heavy duty liquid detergents to provide the properties of thickening, soil release and anti-redeposition. Thickening of aqueous formulations is desirable for both practical and aesthetic reasons. Liquids with a water-like viscosity are perceived by consumers as less effective than more viscous liquids. Thicker compositions tend to remain on soiled areas to which they are applied for pre-wash treatment. Longer residence time at soil sites improves directed cleaning ability.

Soil release refers to the protective coating of cellulose ether deposited onto the fabric in a previous wash. Removal of stains is facilitated in subsequent washes, the previously deposited soil release film forming a protective coating over the fabric.

Anti-redeposition properties refer to the cellulose ether ability to suspend soil in the wash liquor preventing reprecipitation of soil onto fabric. Accordingly, cellulose ethers are highly desirable components for liquid detergent formulations.

Unfortunately, heavy duty liquid detergents are fickle beasts. Shelf stability is not one of their noteworthy attributes. Liquid detergent formulations contain a cast of characters having mutually antagonistic properties. Organic surfactants must be reconciled with inorganic salts and water. Not least are the cellulose ethers which remain a difficult component to compatibilize within the liquid system.

Freeze-thaw and low temperature storage stability can be particularly poor with cellulose ethers in certain built, mixed anionic-nonionic liquid detergents. In cold weather, phase separation occurs and cellulose ether drops from suspension as gelatinous, ungainly lumps.

Accordingly, it is the prime object of this invention to provide a heavy duty liquid detergent containing cellulose ether that remains in homogeneous suspension even under freeze-thaw and low temperature storage conditions.

SUMMARY OF THE INVENTION

An aqueous liquid detergent composition is provided comprising:

(1) from about 0.5% to about 2% glycerol;

(2) from about 0.05% to about 1% cellulose ether;

(3) from about 3% to about 6% of a nonionic surfactant; and (4) from about 10% to about 25% of an anionic surfactant.

Furthermore, a method is provided for stabilizing the suspension of cellulose ethers in aqueous liquid detergents by the use of glycerol.

DETAILED DESCRIPTION OF THE INVENTION

It has been discovered that the addition of glycerol to an aqueous liquid detergent containing cellulose ether, nonionic-anionic surfactant and builder will prevent phase separation and lumping of cellulose ether both during storage of the composition at 35° F. and under freeze-thaw cycling. Alcohols other than glycerol were found to be ineffectual. Neither ethanol, ethylene glycol nor propylene glycol delivered the storage stability benefits of glycerol. In fact, these other alcohols even contributed to deterioration of cellulose ether stability.

Cellulose ethers are a well known class of materials. Those useful in the present invention are generally derived from vegetable tissues and fibers, including especially cotton and wood. The hydroxyl group of the anhydroglucose unit of cellulose can be reacted with various reagents thereby replacing the hydrogen of the hydroxyl with other chemical groups. Various alkylating agents can be reacted with the cellulose materials to produce alkyl cellulose ethers. The degree of substitution may vary up to 3.0 since there are three available positions on each anhydroglucose unit.

Methyl cellulose ethers are the preferred variety of cellulose ethers useful with the present invention. These polymers are commercially available in a variety of viscosities, molecular weights and degrees of substitution. Particularly preferred is a methyl cellulose sold under the trademark Methocel A by the Dow Chemical Company. The material has a methoxyl degree of substitution ranging from 1.64 to 1.92 and methoxyl content of 27.5 to 31.5%. In a 2% solution at 20° C., Methocel A has a viscosity ranging from about 80 to 120 cP.

The liquid detergent systems of this invention are directed at mixed anionic-nonionic surfactant compositions. A wide variety of anionic surfactants may be utilized. Anionic synthetic detergents can be broadly described as surface active compounds with negatively charged functional group(s). An important class of compounds within this category are the water-soluble salts, particularly the alkali metal salts, of organic sulfur reaction products having in their molecular structure an alkyl radical containing from about 8 to about 22 carbon atoms and a radical selected from the group consisting of sulfonic acid and sulfuric acid ester radicals. Such surfactants are well known in the detergent art and are described at length in "Surface Active Agents and Detergents", Vol. II, by Schwartz, Perry & Berch, Interscience Publishers, Inc., 1958, herein incorporated by reference.

Particularly suitable anionic surfactants for the instant invention are the higher alkyl mononuclear aromatic sulfonates. They contain from 10 to 16 carbon atoms in the alkyl chain. Alkali metal or ammonium salts of these sulfonates are suitable, although the sodium salts are preferred. Specific examples include: sodium linear tridecyl benzene sulfonate; sodium linear pentadecyl benzene sulfonate; and sodium p-n-dodecyl benzene sulfonate. These anionic surfactants are present usually from about 10 to about 25% by weight of the total composition. More preferably, they are present from 15 to 20%.

Nonionic synthetic detergents can be broadly defined as surface active compounds which do not contain ionic functional groups. An important group of chemicals within this class are those produced by the condensation of alkylene oxide groups (hydrophilic in nature) with an organic hydrophobic compound, the latter being aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative but not limiting examples of the various chemical types of suitable nonionic surfactants include:

(a) polyoxyethylene or polyoxypropylene condensates of aliphatic carboxylic acids, whether linear- or branched-chain and unsatuated or saturated, containing from about 8 to about 18 carbon atoms in the aliphatic chain and incorporating from 5 to about 50 ethylene oxide or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid.

(b) polyoxyethylene or polyoxypropylene condensates of aliphatic alcohols, whether linear- or branched-chain and unsaturated or saturated, containing from about 8 to about 24 carbon atoms and incorporating from about 5 to about 50 ethylene oxide or propylene oxide units. Suitable alcohols include the "coconut" fatty alcohol, "tallow" fatty alcohol, lauryl alcohol, myristyl alcohol and oleyl alcohol. Examples of nonionic surfactant compounds in this category are the "Neodol" type products, a registered trademark of the Shell Chemical Company. Neodol 25-9, a $C_{12}$–$C_{15}$ linear primary alcohol ethoxylated with an average of 9 moles ethylene oxide has been found useful. Most preferred, however, is Neodol 23-6.5 which is a $C_{12}$–$C_{13}$ alcohol ethoxylated with an average of 6.5 moles ethylene oxide.

(c) polyoxyethylene or polyoxypropylene condensates of alkyl phenols, whether linear- or branched-chain and unsaturated or saturated, containing from about 6 to about 12 carbon atoms and incorporating from about 5 to about 25 moles of ethylene oxide or propylene oxide.

Appropriate concentrations for the nonionic surfactant range from about 3% to about 6% by weight of the total formulation.

The compositions of this invention may contain detergent builders. Useful builders can include any of the conventional inorganic and organic water-soluble builder salts.

Typical of the well known inorganic builders are the sodium and potassium salts of the following: pyrophosphate, tripolyphosphate, orthophosphate, carbonate, bicarbonate, silicate, sesquicarbonate, borate and alumino silicate.

Among the organic detergent builders that can be used in the present invention are the sodium and potassium salts of citric acid and nitrilotriacetic acid. Particularly preferred among all the detergent builders is, however, citric acid.

The detergent builders of this invention are generally used in a concentration range of from about 2% to about 15% by weight of the total formulation. Preferably, they are present from about 5% to about 10%.

The presence of a hydrotrope within the composition is highly desirable. Hydrotropes are substances that increase the solubility in water of another material which is only partially soluble. Preferred hydrotropes are the alkali metal salts of benzene sulfonic acid, toluene sulfonic acid and xylene sulfonic acid. These hydrotropes are present from about 2% to about 5% by weight of the total composition.

Apart from the aforementioned cellulose ethers, surfactants, builders and hydrotropes, the compositions may contain all manner of minor additives commonly found in such liquid detergents and in amounts in which such additives are normally employed. Examples of these additives include: lather boosters, lather depressants, oxygen or chlorine-releasing bleaching agents, fabric softening agents, inorganic salts and buffering agents. Usually present in very minor amounts are fabric whitening agents, perfumes, enzymes, preservatives, opacifiers and colorants.

Stability Evaluation Procedures

The procedure for evaluating freeze-thaw stability involves subjecting samples in typicl commercial narrow mouth bottles to six controlled freeze-thaw cycles between 0° F. and 70° F. over a period of two weeks. Cycling time between 0° F. and 70° F. is 24 hours, except over weekends when temperature is maintained at 70° F. for 48 hours. Six hours are necessary for the temperature in the room to drop from 70° F. to 0° F. and 4 hours to rise from 0° F. to 70° F. These cycles are thought to simulate the most extreme conditions for storage and transportation of commercial products during winter months.

The major type of instability developing under freeze-thaw or low temperature storage is sedimentation and/or gelation of cellulosics. Measurement of this instability involves, after suitable storage, carefully pouring out the contents of the sample bottle. The volume of clear supernatant above the opaque cellulosics layer is then estimated. This volume as a percent of total sample volume is referred to as percent cellulosics "down". In addition, as the remainder of the contents are poured out, the type of sedimentation and gelation are described. A scale has been developed to reflect this degree of solid formation (DSF) during freeze-thaw or low temperature storage. Minor changes in appearance are not reflected by the scale values. It deals solely with major differences in lumpiness levels that may effect consumer perception of product consistency and pourability. Products are rated from 1 to 5+ on DSF scale shown below.

| Rating | Degree of Solid Formation | Likelihood of Being Consumer Perceivable | Impedence To Pouring |
|---|---|---|---|
| 1 | None | None | None |
| 2 | Very slight lumpiness | None | None |
| 3 | Clear evidence of lumpiness | Slight | None |
| 4 | Heavy lumpiness throughout liquid | Probably | Slight |
| 5 | Heavy single lump formation on bottom of jar that begins to break upon pouring | Very probable | Significant |
| 5+ | Heavy single lump formation on bottom of jar that remains intact on pouring | Certain | Very Significant |

In addition, the ease of pouring is rated under a separate scale outlined below:

| Rating | Pourability |
|---|---|
| A | Contents pour out readily. |
| A[1] | Contents pour out readily but at a reduced rate. |
| B | Gentle shaking necessary to expel entire contents of bottle. |
| B[1] | Moderate to vigorous shaking necessary to expel |

-continued

| Rating | Pourability |
|---|---|
| | entire contents of bottle. |
| C | Gentle squeezing of bottle required to expel entire contents. |
| $C^1$ | Moderate to extreme squeezing of bottle required to expel entire contents. |

The same procedures described above were also used for product stored at 35° F. and 0° F.

The following examples will more fully illustrate the embodiments of this invention. All parts, percentages and proportions referred to herein and in the appended claims are by weight unless otherwise indicated.

EXAMPLE I

The following formulation illustrates a heavy duty liquid detergent that suffers from storage and freeze-thaw stability problems. It represents the base formulation.

TABLE 1

| Component | Weight % |
|---|---|
| Sodium linear alkyl benzene sulfonate | 17 |
| Neodol 23-6.5 | 6 or 7 |
| Sodium xylene/toluene sulfonate | 5 |
| Sodium citrate.$2H_2O$ | 5 |
| Monoethanolamine | 2 |
| Methyl cellulose ether | 0.45 |
| Coconut fatty acid | 0.5 |
| Perfume | 0.15 |
| Opacifier | 0.05 |
| Fabric whitening agent | 0.085 |
| Colorants | 0.008 |
| Water up to | 100 |

EXAMPLE II

The effect of glycerol, ethylene glycol and propylene glycol on freeze-thaw stability in the base formulation of Example I are presented in Table 2.

TABLE 2

| % Neodol 23-6.5 | Additive | ml. Supernatent | DSF Rating | Pourability Rating |
|---|---|---|---|---|
| 6 | — | 65 | 5+ | C |
| 6 | 2% propylene glycol | 80 | 5+ | $C^1$ |
| 6 | 2% ethylene glycol | 80 | 5+ | $C^1$ |
| 6 | 1% glycerol | 40 | 2 | A |
| 6 | 2% glycerol | 35 | 2 | A |
| 7 | 1% glycerol | 50 | 5+ | C |
| 7 | 2% glycerol | 45 | 5+ | C |

From the table, it is evident that glycerol dramatically improves freeze-thaw stability with 6% Neodol 23-6.5. Under similar conditions, ethylene glycol and propylene glycol did not improve freeze-thaw stability. Glycerol did not benefit the composition when the Neodol 23-6.5 concentration was raised to 7%.

Similar benefits are observed after four weeks storage at 35° F. Results are recorded in Table 3.

TABLE 3

| % Neodol 23-6.5 | Additive | ml. Supernatent | DSF Rating | Pourability Rating |
|---|---|---|---|---|
| 6 | — | trace | 3–4 | B |
| 6 | 2% propylene glycol | trace | 4–5 | C |
| 6 | 2% ethylene glycol | trace | 4–5 | C |
| 6 | 1% glycerol | 0 | 1 | A |
| 6 | 2% glycerol | 0 | 1–2 | A |

TABLE 3-continued

| % Neodol 23-6.5 | Additive | ml. Supernatent | DSF Rating | Pourability Rating |
|---|---|---|---|---|
| 7 | 1% glycerol | trace | 4 | A' |
| 7 | 2% glycerol | trace | 3 | A' |

Once again, glycerol improves 35° F. stability whereas both ethylene glycol and propylene glycol are detrimental.

EXAMPLE III

Addition of ethanol does not improve freeze-thaw stability but, in fact, aggravates the problem. Table 4 illustrates the results of combining from 1 to 2% ethanol with the formulation of Example I using 6% Neodol 23-6.5. When ethanol is added, the supernatant becomes unusually clear indicating almost complete sedimentation of cellulosics and possibly opacifier. The rigidity of the cellulosics lump formed is such that it is extremely difficult to squeeze the solid from the bottle. This was one of the worst cases of instability observed. Ethanol is totally unacceptable for use in this particular formulation.

TABLE 4

| Effect of Ethanol on Stability | | | |
|---|---|---|---|
| % Ethanol | % Supernatent | DSF Rating | Pourability Rating |
| 0 | 75 | 5+ | $C^1$ |
| 1 | 90 | 5+ | $>C^1$ |
| 2 | 90 | 5+ | $>C^1$ |
| 2 | 90 | 5+ | $>C^1$ |

It should be noted that ethanol is advantageous for 35° F. stability. A formulation with 7% Neodol 23-6.5 and 2% ethanol has a DSF rating of 1. In the absence of ethanol the DSF rating is 5+.

The foregoing description and examples illustrate selected embodiments of the present invention and in light thereof variations and modifications will be suggested to one skilled in the art, all of which are in the spirit and purview of this invention.

What is claimed is:

1. An aqueous liquid detergent composition comprising:

(1) from about 0.5% to about 2% glycerol;

(2) from about 0.05% to about 1% cellulose ether;

(3) from about 3% to about 6% of a nonionic surfactant; and (4) from about 10% to about 25% of an anionic surfactant wherein each of said components are based by weight on 100 percent of the total composition; and the balance being water.

2. An aqueous liquid detergent composition according to claim 1 wherein the cellulose ether is methyl cellulose.

3. An aqueous liquid detergent composition according to claim 1 where the cellulose ether is present from about 0.2% to about 0.8%.

4. An aqueous liquid detergent composition according to claim 1 further comprising from about 2% to about 15% of a builder by weight of the total composition.

5. An aqueous liquid detergent composition according to claim 4 wherein the builder is sodium citrate.

6. An aqueous liquid detergent composition according to claim 4 wherein the builder is present from about 5% to about 10% by weight of the total composition.

7. An aqueous liquid detergent composition according to claim 1 wherein the anionic surfactant is present from about 15% to about 20% by weight of the total composition.

8. An aqueous liquid detergent composition according to claim 1 wherein the nonionic surfactant is a $C_{12}$–$C_{18}$ alcohol ethoxylated with from about 3 to about 20 moles ethylene oxide.

9. An aqueous liquid detergent composition according to claim 1 wherein the nonionic surfactant is a $C_{12}$–$C_{13}$ alcohol ethoxylated with an average of 6.5 moles ethylene oxide.

10. An aqueous liquid detergent composition according to claim 1 further comprising from about 2% to about 5% of a hydrotrope.

11. An aqueous liquid detergent composition according to claim 10 wherein the hydrotrope is an alkali metal or ammonium salt of an alkyl benzene sulfonic acid.

12. An aqueous liquid detergent composition according to claim 11 wherein the alkyl benzene sulfonic acid salt is either sodium xylene sulfonate or sodium toluene sulfonate.

13. An aqueous liquid detergent composition comprising:

(1) from about 0.5% to about 2% glycerol;
(2) from about 0.2% to about 0.8% methyl cellulose ether;
(3) from about 3% to about 6% of a $C_{12}$–$C_{13}$ alcohol ethoxylated with an average of 6.5 moles ethylene oxide;
(4) from about 10% to about 25% of sodium linear alkyl benzene sulfonate;
(5) from about 5% to about 10% of sodium citrate; and
(6) from about 2% to about 5% of sodium salt of xylene or toluene sulfonate wherein each of said components are based by weight on 100 percent of the total composition; and the balance being water.

14. A method for stabilizing the suspension of cellulose ethers in aqueous heavy duty liquid detergents comprising adding from about 0.5% to about 2% glycerol to an aqueous detergent comprising:

(1) from about 0.05% to about 1% cellulose ether;
(2) from about 3% to about 6% of a nonionic surfactant; and
(3) from about 10% to about 25% of an anionic surfactant wherein each of said components are based by weight on 100 percent of the total composition; and the balance being water.

* * * * *

UNITED STATES PATENT AND TRADEMARK OFFICE

CERTIFICATE OF CORRECTION

PATENT NO. : 4,566,993

DATED : January 28, 1986

INVENTOR(S) : Secemski et al.

It is certified that error appears in the above—identified patent and that said Letters Patent is hereby corrected as shown below:

Column 4, line 15, delete "typicl" and insert -- typical --.

Column 5, Table 2, line 43, delete "ml." and insert -- % --.

Column 5, Table 3, line 63, delete "ml." and insert -- % --.

Column 6, Table 3, line 2, delete "ml." and insert -- % --.

Signed and Sealed this

*Twenty-second* Day of *July 1986*

[SEAL]

*Attest:*

DONALD J. QUIGG

*Attesting Officer*

*Commissioner of Patents and Trademarks*